US005404916A

United States Patent [19]

Mueller et al.

[11] Patent Number: 5,404,916

[45] Date of Patent: Apr. 11, 1995

[54] LOOM METHOD AND APPARATUS FOR AVOIDING BEAT UP MARKINGS IN A FABRIC

[75] Inventors: Herbert Mueller, Kressbronn; Valentin Krumm, Hergensweiler; Fritz Gehring, Bodolz, all of Germany

[73] Assignee: Lindauer Dornier GmbH, Lindau, Germany

[21] Appl. No.: 123,646

[22] Filed: Sep. 17, 1993

[30] Foreign Application Priority Data

Sep. 19, 1992 [DE] Germany ..... 42 31 459.3

[51] Int. Cl.[6] ..... D03D 47/30

[52] U.S. Cl. ..... 139/116.2; 139/1 E

[58] Field of Search ..... 139/116.2, 1 R, 1 E

[56] References Cited

U.S. PATENT DOCUMENTS

| | | | |
|---|---|---|---|
| 4,989,644 | 2/1991 | Tanaka et al. | 139/116.2 |
| 5,224,520 | 7/1993 | Shinbara et al. | 139/116.2 |
| 5,228,480 | 7/1993 | Tamura | 139/116.2 X |

FOREIGN PATENT DOCUMENTS

| | | |
|---|---|---|
| 2509665 | 9/1976 | Germany . |
| 2706646 | 8/1978 | Germany . |
| 4137681 | 5/1992 | Germany . |

*Primary Examiner*—Andrew M. Falik
*Attorney, Agent, or Firm*—W. G. Fasse; W. F. Fasse

[57] ABSTRACT

When a faulty weft thread must be removed after it has been bound into the fabric and beat-up, it is necessary to perform a so-called reverse weaving operation following the stopping of the normal weaving operation in response to a stop signal signifying that a faulty weft thread has been detected. For this purpose the loom main shaft and the heald drive shaft are rotated for a number of rotational degrees in the same direction in which these shafts are rotated just prior to the stopping of a weaving operation in response to the above mentioned signal. Next, the drive between the main shaft and the heald shaft is interrupted. Next, the main shaft and thus also the reed shaft and with it the reed, are rotated back within a predetermined angular range between two successive reed beat-up motions. During this time the heald shaft is rotated back, preferably to the so-called detection point with a higher r.p.m., or rather with a higher angular speed than the main shaft. This function is accomplished by an auxiliary step-up transmission gear between the main shaft and the heald shaft. The auxiliary gear is bypassed during normal operation when there is no weft fault and it is connected in series during the operation for removing of a faulty weft thread.

9 Claims, 4 Drawing Sheets

LOOM METHOD AND APPARATUS FOR AVOIDING BEAT UP MARKINGS IN A FABRIC

FIELD OF THE INVENTION

The invention relates to a method and apparatus for avoiding the formation of markings in a fabric being woven on a loom having a heald section. Such markings can be caused by a reed beat-up motion that conventionally takes place during a so-called "reverse weaving" operation performed for removing a faulty weft thread.

BACKGROUND INFORMATION

Undesirable markings are formed in a fabric when a faulty weft thread has been bound into the fabric and beat-up and then must be removed again. Such markings reduce the quality of the fabric and must be avoided. The removal of the faulty weft thread requires the reverse weaving, for example, if a broken weft thread has already been beat-up against the beat-up edge of the fabric by the respective motion of the reed. As soon as a sensor recognizes the presence of a broken weft thread, the loom is stopped. However, due to inertia the stopping cannot be so instantaneous that beat-up of the broken weft thread is avoided. Rather, the broken weft thread is still bound-in and beat-up because the motor driven main shaft of the loom, the reed drive shaft, and the heald drive shaft of the loom come to a standstill only after about 60° of rotation following the reed beat-up. The heald drive shaft of the heald loom section also participates in this additional rotation because it is connected through a power transmission with the main shaft of the loom. When standstill has been achieved, the loom shed is opened again by reverse rotation of the involved loom components through a number of angular degrees in the reverse direction sufficient to open the loom shed. Preferably, the opening of the loom shed is performed simultaneously with a controlled reverse rotation of the warp beam and of the cloth or fabric take up roller. When the loom shed is sufficiently opened, the faulty or broken weft thread is removed and the loom main shaft as well as the reed shaft are rotated in the forward direction into an angular rotational position that is required for restarting the loom.

A stopping of the weaving operation and thus of the loom drive may be necessary due to the most varied causes. For example, the weaving operation must be interrupted when a faulty weft thread has been inserted into the loom shed and the switching of the upper and lower warp threads has bound the faulty weft thread into the fabric, whereby the stopping is initiated after the detection of the presence of a faulty weft thread. As mentioned, in such an instance the main drive shaft of the loom stops at a rotational angle of about 60° following the beat-up of the weft thread by the reed. The defective weft thread is thus bound-in and beat-up in the finished part of the fabric web being woven.

In order to eliminate the so-called weft fault, it is unavoidable that the loom shed must be opened again by the above mentioned reverse rotation of about 60 or more rotational degrees of the main loom shaft and by also reverse rotating the heald drive shaft. Once the loom shed is sufficiently open, the defective beat-up weft thread is removed from the fabric portion. Such removal may take place in any known manner.

After the defective weft thread has been removed it is necessary to return all the loom components to a position in which these components have been prior to the beat-up of the defective weft thread. These components include not only components rotated by the main shaft, but also the electronic controls and mechanical elements of the heald section. In looms wherein the loom main shaft serves simultaneously as a drive for the heald section, the loom and the heald loom section are rigidly coupled through gear drive means. When in such looms the coupling is disconnected, the reed necessarily performs a further beat-up motion prior to returning of the reed into its back position. Such additional beat-up motion of the reed is unavoidable in the type of loom just mentioned. This additional beat-up leads to undesirable markings or so-called weft stripes that become frequently visible only after further treatment of the fabric such as dyeing or mercerizing. The markings occur because the forward beat-up motion compresses the fabric along the beat-up line and the fabric tries to expand along the beat-up line when the reed moves back.

German Patent Publication (DE-OS) 4,137,681 discloses an effort to avoid these fabric markings by shifting the fabric, or rather the fabric beat-up line, in the direction of the fabric withdrawal from the loom. The just mentioned German Patent Publication discloses the operation of devices that are intended to protect the fabric beat-up edge against the beat-up by the reed during the so-called reverse weaving. For this purpose these devices become operational during reverse weaving that is during the slow reverse rotation of the main loom shaft or of the loom motor that is connected with the main shaft. These devices shift the fabric edge and thus the beat-up edge or line prior to a renewed beat-up by the reed, out of the normal position by a certain distance in the direction of the fabric withdrawal. Once the reverse weaving is completed, these devices return the fabric and thus the fabric beat-up line or edge into the normal position. It is a disadvantage of the just described device according to German Patent Publication (DE-OS) 4,137,681 that a substantial control effort and expense is necessary for the mentioned fabric shifting.

It is also known to decouple the heald loom section from the driving side of the loom main drive shaft after the loom had been stopped in response to the detection of a weft fault. In such a case, a separate drive that is operatively coupled to the drive shaft of the heald loom section takes care of the reverse rotation of the loom main drive shaft, whereby, through the heddles the previous beat-up is opened up again and the warp threads release the defective weft thread without any movement of the reed. In other words, in this type of operation, the loom shed is reproduced in its state when the defective weft thread has been introduced. After removal of the defective weft thread the loom is started again and the preceding weft thread insertion is repeated without any beat-up motion of the reed prior to such repeated weft thread insertion.

German Patent Publication (DE-OS) 2,509,665 discloses a loom with a shed forming mechanism particularly for a heald loom or a Jacquard loom in which the shed forming mechanism and if applicable, a weft thread selection mechanism, are connectable through a main shaft clutch, either to the main shaft or to a reverse drive device. Thus, when a weaving fault, such as a weft thread fault occurs, the shed forming mechanism and the weft thread selection device, if such device is used, are decoupled from the main drive shaft and coupled to the reverse drive mechanism, whereby the latter comprises a reverse drive motor and a reverse switching clutch. In such a conventional loom, the reverse drive device is so constructed that the removal of a weaving fault can be accomplished in substantially less time than without such a device. For this purpose the just mentioned German Patent Publication suggests that a stepping gear drive is arranged between the reverse drive clutch and the reverse drive motor. The stepping gear drive is so constructed that it has a rather increased reduction ratio between the initial step and the last step of the stepping. However, German Patent Publication (DE-OS) 2,509,665 does not mention that the backward weaving normally entails a renewed beat-up of the reed against the fabric edge which leads to a densification of the fabric and to the so-called stripe formation. Besides, the just mentioned known loom requires a separate reverse drive motor for the reverse weaving operation performed by the reverse drive mechanism.

German Patent Publication (DE-OS) 2,706,646 describes a solution to the above problems in looms in such a way that in response to a weaving fault the operational motion of the reed is stopped in a preliminary stopping position. Once the reed is stopped, it is brought into a desired stopping position by a positioning motion which is slower than the normal operational motion. This known solution to the above problem further uses the loom drive motor also for the slow drive of the reed or loom sley. For this purpose the loom drive motor is an electric motor having a variable r.p.m. However, German Patent Publication (DE-OS) 2,706,646 also mentions that a separate motor may be provided for this slow drive in addition to the regular loom drive motor. This additional motor also serves for the backward motion of the heald loom section that is for the backward weaving. Thus, at least in connection with looms equipped with a heald loom section it is necessary to provide, in addition to the normal gear drives, a coupling mechanism for decoupling and again coupling the loom drive from or to the heald loom section thus requiring at least one additional reverse running motor.

OBJECTS OF THE INVENTION

In view of the foregoing it is the aim of the invention to achieve the following objects singly or in combination:

to avoid a renewed beat-up motion of the reed during the so-called reverse weaving, namely when the binding of a faulty weft thread must be opened up again;

to provide an apparatus that is capable of avoiding the renewed beat-up motion of the reed when it becomes necessary to open up a bound-in or beat-up faulty weft thread and to remove such weft thread, thereby avoiding an additional reverse drive motor;

to derive the motions necessary for the removal of a faulty weft thread from the main loom drive; and to reduce the technical effort and expense with regard to control features that are conventionally necessary for the above described removal of a faulty weft thread.

SUMMARY OF THE INVENTION

The invention achieves the above objects by performing the following steps in the operation of a loom. First, the presence of a faulty weft thread is detected, for example by a weft stop motion device and a weaving stop signal is generated in response to the detection. The stop signal is used to stop the weaving operation, while causing a temporarily continuing rotation of the loom main drive shaft, of a reed drive shaft, and of a heald drive shaft in the same direction in which these three shafts were rotating at the time when the weaving operation was stopped. The continuing rotation passes through an angular range for a first number of rotational degrees that is smaller than 360°. Then an auxiliary gear drive is switched from a first forward drive at a first transmission ratio to a second reverse drive with a stepped-up second transmission ratio compared to said first transmission ratio for causing a simultaneous reverse rotation of the reed drive shaft and of the heald drive shaft in a direction opposite to the first temporarily continuing rotation, in such a way that a second number of reverse rotational degrees of said heald drive shaft (16) is larger than 360°. Last, the auxiliary gear drive is switched down from said second transmission ratio to said first transmission ratio whereby a beat-up motion is avoided during a so-called back-weaving for removing a faulty weft thread. A loom according to the invention for performing the present method is equipped with an auxiliary gear drive, and with a coupling device for switching the auxiliary gear drive. These components are inserted between a transmission output shaft and a heald shaft. The auxiliary gear drive has first gear wheels and second gear wheels. The second gear wheels are so dimensioned that a step-up transmission ratio i within the range of i=1:2 to 1:3 is achieved by the second gear wheels compared to the first gear wheels. The first gear wheels first rotate said heald drive shaft in a temporary rotation in the same direction in which the heald drive shaft was rotating at the time of or just prior to a stopping of a weaving operation. The temporary rotation passing through an angular range that is smaller than 360°. The coupling device disconnects the heald drive shaft from the first gear wheels and connects the heald drive shaft to the second gear wheels of said auxiliary gear drive for causing a reverse rotation of the heald drive shaft in a direction opposite to the first temporary rotation at a higher angular speed than the forward rotation of the main drive shaft and in accordance with the step-up ratio i.

The weft fault removal operation according to the invention and the apparatus for performing this operation make sure that a beat-up of the reed is avoided during the so-called backward weaving for the purpose of a weft fault removal. Thus, the invention positively avoids undesirable markings in the fabric which heretofore were caused by the reed beat-up during the so-called backward weaving for the purpose of removing a faulty weft thread.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

The following example embodiment will be described with reference to a loom having a heald loom section. The shed forming components of such a loom include the heald shafts or heddles for binding the weft threads into the warp threads. The reed beam with its reed for beat-up of the weft threads is driven by the reed drive shaft. The heald loom section for forming and shifting the loom shed is driven by the heald drive shaft. The main drive of the loom with its loom main shaft drives both the reed drive shaft and the heald drive shaft through a respective coupling and power transmission.

Figure 1:
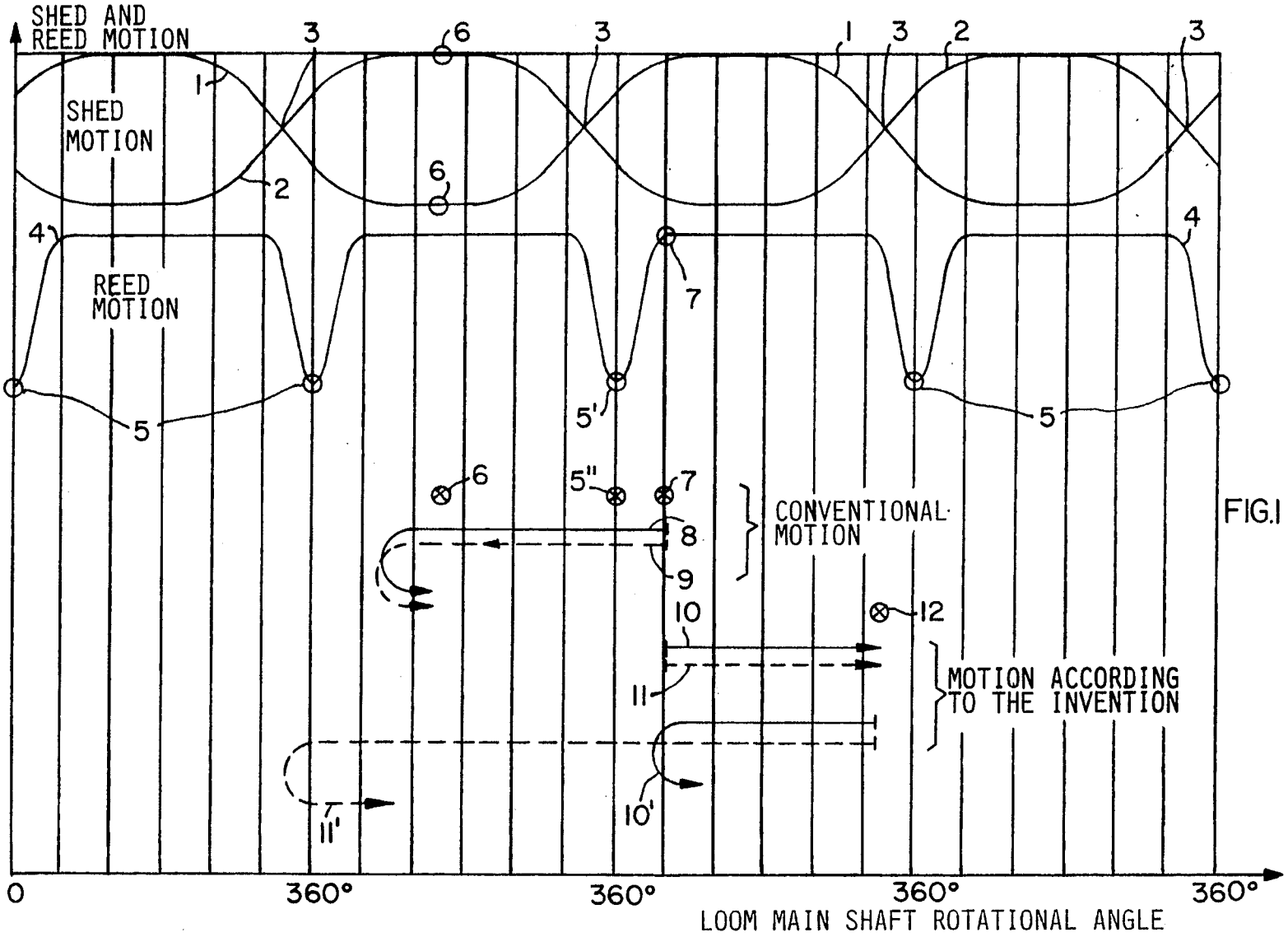
FIG. 1 is a motion diagram, wherein the ordinate designates motions of the reed and of the loom shed while the abscissa designates rotational degrees, and wherein a conventional motion sequence is compared with a motion sequence of the invention.

FIG. 1 illustrates on the ordinate the motion of the shed forming warp threads and the reed motion as a function of the rotational angle of the loom main shaft. Four full 360° revolutions of the loom main shaft are shown along the abscissa. During the first revolution the curve 1 represents the upper warp threads for forming the loom shed while the curve 2 represents the lower warp threads for forming the loom shed. The change-over from upper loom shed to lower loom shed and vice versa takes place at the intersection 3 between the two curves 1 and 2. A curve 4 represents the reed motion, whereby a beat-up 5 takes place for each full revolution of the loom main shaft. The beat-up 5 takes place shortly after the shed switch-over at the intersection 3. Thus, any weft thread that has been bound into the fabric at 3 is beat-up at 5, whereby, as mentioned, the binding of the weft thread into the fabric takes place just prior to the beat-up. In other words, beat-up follows a few rotational degrees of the loom main shaft after the binding operation at the time of shed switch-over at the intersection 3. It is conventional that in response to the detection of a weft thread break the weaving operation is stopped when a weft thread break has been detected at 6, the respective weaving stop signal is produced instantly, but the inertia moments of the rotating loom components and of the shed forming components prevent an instantaneous stopping of the loom. Rather, the loom main shaft only stops at 7, which is about 60 angular degrees after the weft thread beat-up by the reed. As a result, the faulty weft thread is not only bound into the fabric, it has also been beat-up as indicated at 5' before the weaving comes to a stop at point 7.

In order to automatically remove a defective weft thread from the fabric, it is necessary to perform a so-called reverse weaving operation to restore the relevant loom components from the position they are in at point 7 into a position in which they were at point 6. For this purpose the loom main shaft must be rotated in the reverse direction, whereby also the reed drive shaft and the heald drive shaft that drives the heald section of the loom must slowly move from point 7 through point 5' to point 6. The respective conventional motions are shown by the arrow 8 for the return of the reed drive shaft and by the dashed line arrow 9 for the heald drive shaft. It will be noted that these reverse motions 8 and 9 involve for the curve 4 representing the reed motion a renewed beat-up of the defective weft thread at 5''. This renewed beat-up takes place prior to the opening of the loom shed for the removal of the defective weft thread. This renewed beat-up leads, as mentioned above, to the undesirable densification of the fabric relative to the future weaving operation, whereby visible stripes are formed in the fabric which become especially visible after further treatment of the fabric, such as dyeing, mercerizing, or the like.

Contrary to the above described conventional motion sequence, the invention teaches to first avoid reverse rotation indicated by the arrows 8 and 9 following a weaving stop at point 7 and to instead continue the rotation to a point 12 which is a point corresponding to a point just prior to the weaving stop at point 7. Thus, the full line arrow 10 indicates the continued rotation of the reed drive shaft and the dashed line arrow 11 indicates the continued rotation of the heald drive shaft until the point 12 is reached. Hence, a repeated beat-up of the defective weft thread is avoided. The continued rotation as indicated by the arrows 10 and 11 is through a rotational angular range smaller than 360°. The continued rotation is relatively slow compared to the normal weaving operation.

According to the invention, the power transmission between the loom main drive shaft and the heald drive shaft is decoupled at point 12 while simultaneously coupling a gear transmission ratio for the driving of the heald drive shaft and rotating of the reed drive shaft and the loom main drive shaft in a rotational direction opposite to the previous rotational direction indicated by the arrows 10 and 11. For this reverse rotation, the number of rotational angular degrees of the loom main drive shaft is smaller than 360° and the number of rotational degrees of the heald drive shaft is larger than 360° as indicated by the arrows 10' and 11', respectively. For this purpose, the step-up transmission ratio produced by the above mentioned second gear wheels is within the range of 1:2 to 1:3. Thus, the heald drive shaft can be rotated with a higher angular speed than the loom main drive shaft. Prior to restarting the weaving operation of the loom, the power transmission coupling between the loom main drive shaft and the heald drive shaft is restored at a precise angular position.

According to the invention, a renewed beat-up motion of the reed during the so-called reverse weaving, is avoided because the heald drive shaft and thus the heald section of the loom, is moved back to the so-called detection point in the same duration time in which the reed is moved back within a fixed range between two reed beat-up motions.

Figure 2:
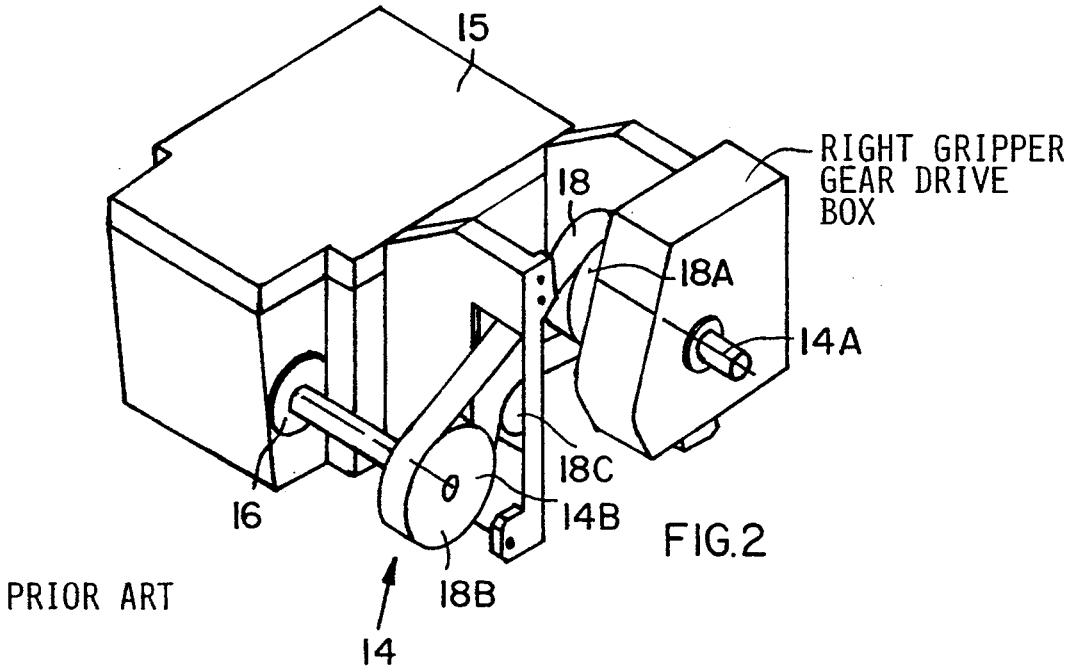
FIG.2 PRIOR ART
FIG. 2 illustrates schematically a conventional drive for the heald section of a loom.

FIG. 2 shows a conventional drive mechanism in which the heald loom section 15 is merely shown as a box that has its own heald drive shaft 16 which is a driven shaft. The driven heald shaft 16 is coupled to the loom main shaft 17 through a power transmission device 14 also referred to as heald drive gear 14, which comprises, for example, a belt and pulley transmission including an input drive shaft 14A, an output drive shaft 14B, a belt pulley 18A, a drive belt 18, such as a V-belt, and a further pulley 18B connected to the heald drive shaft 16. The power transmission between the loom main shaft 17 and the reed drive shaft 17A may be of identical construction. Incidentally, an idler pulley or guide roller 18C keeps the belt 18 properly tensioned and trained.

Figure 3:
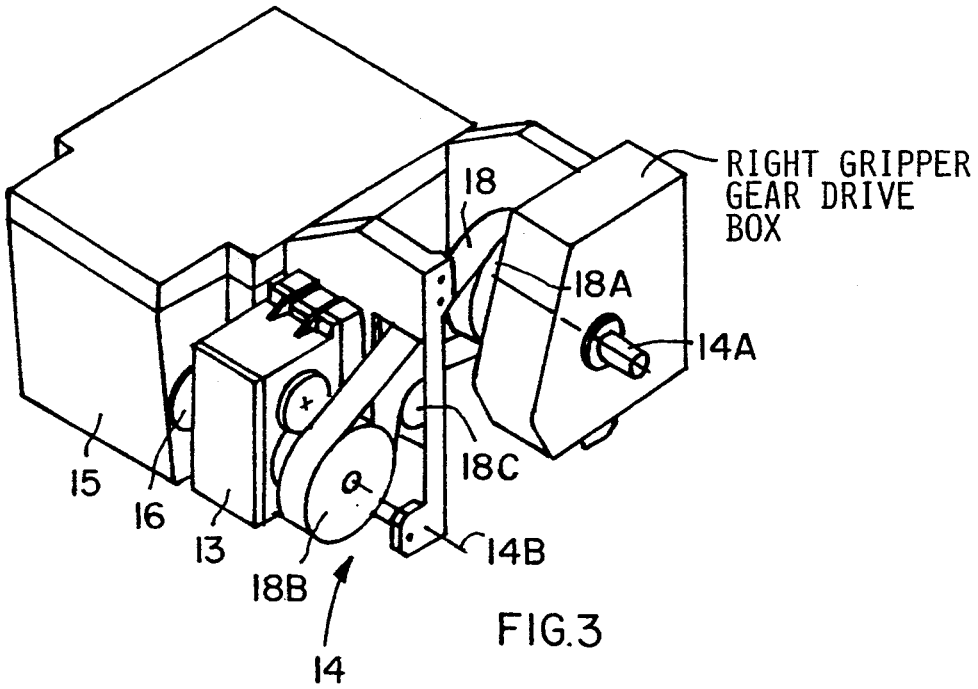
FIG. 3 illustrates a view similar to that of FIG. 2, but now showing the auxiliary gear for the heald drive of the loom according to the invention.
Figure 4:
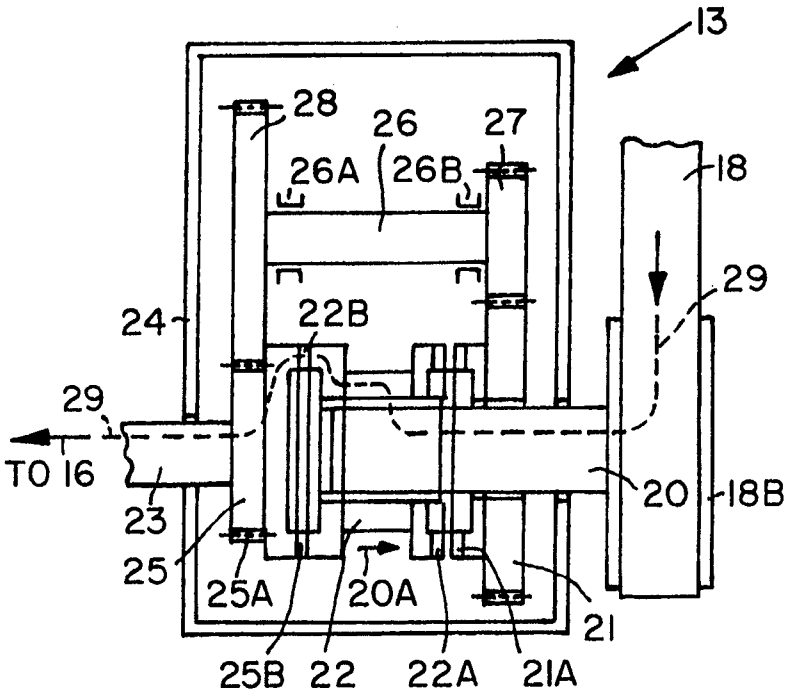
FIG. 4 illustrates the operation of the present loom under the normal operating conditions when there is no weft fault.

FIG. 3 shows the apparatus according to the invention in which an auxiliary gear drive or power transmission 13 has been interposed between the power transmission device 14 and the heald drive shaft 16. The auxiliary gear or power transmission drive 13 will now be described in more detail with reference to FIGS. 4 and 5. FIG. 4 illustrates the normal forward power drive train 29 derived from the loom main shaft 17 to input drive shaft 14A and through the belt 18 now passing over a pulley 18B rigidly secured to a rotatably mounted shaft 20. A gear wheel 21 is rotatably mounted on the shaft 20. The gear wheel or pinion 21 has an axially facing coupling element 21A that may comprise, for example, an axially facing gear rim. According to the invention a coupling device 22 in the form of a bushing is mounted on the shaft 20 for axial displacement as indicated by the arrow 20A, but rigidly connected for rotation. Hence, the coupling device 22 rotates with the shaft 20. The coupling device 22 is also equipped with two coupling elements 22A facing axially in one direction and 22B facing axially in the opposite direction. An output shaft 23 rotatabiy mounted in the housing 24 is operatively connected to the heald drive shaft 16 and carries a gear wheel 25 having a radially facing pinion 25A and an axially facing coupling element such as a gear rim 25B. The coupling device 22 is shiftable axially by any suitable drive such as a pneumatic drive, a mechanical drive, or an electromagentic drive symbolically shown in FIG. 4 by the arrrow 20A.

FIG. 4 additionally shows a bypass gear section comprising a rotatably mounted by-pass shaft 26 carrying two by-pass pinions 27 and 28. The shaft 26 is rotatably mounted at 26A and 26B in the housing 24 parallel to the shafts 20 and 23.

Figure 5:
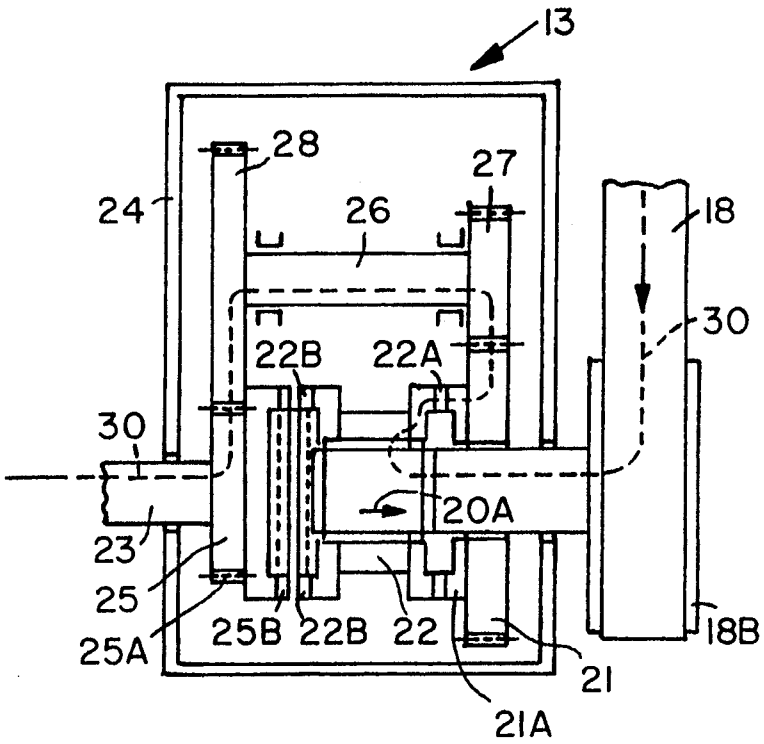
FIG. 5 illustrates the operation of the present heald drive when a weft thread has been detected and a respective weaving stop signal has been generated.

In the shown position of FIG. 4 which is the normal position when no faulty weft thread has been detected, the coupling device 22 in the form of a bushing is shifted to the left, whereby the coupling element or gear rim 22B engages the gear rim 25B of the gear wheel 25, thereby establishing the power transmission train 29 as shown in the forward direction. Thus, the gears 22B and 25B form first gears for the forward drive train 29. In FIG. 5 a different power train 30 is established in response to a signal generated by the detection of a faulty weft thread. Such detection is conventionally performed by a weft stop motion device also known as a weft monitor which causes the loom control to stop the weaving. The invention uses this signal to operate the coupling device 22. As shown, the coupling device 22 has been shifted to the right, whereby the gear rim 21A of the gear wheel 21 is engaged by the coupling element 22A such as another gear rim of the coupling device 22 so that now the power drive passes through the pinion 27 through the shaft 26, through the pinion 28, and through the pinion 25A into the shaft 23 and thus to the heald drive shaft 16. Depending on the axial position of the coupling device 22, either the forward transmission train 29 or a reverse transmission train 30 is established. In FIG. 4, the by-pass pinions 27 and 28 and pinion 25A just idle in parallel to the forward transmission drive train 29. In FIG. 5, the reverse transmission or drive train 30 with the by-pass pinions 27 and 28 is connected in series with the gear wheel 21 and the pinion 25A. More specifically, the reverse drive train 30 includes the second gears in the following sequence: 21A, 22A, 21, 27, 28, 25A.

The just described second gear wheels and pinions are so selected that the above mentioned step-up transmission ratios are accomplished. Thus, when the rotational sequences according to the invention are employed for the removal of a weft fault, the return rotation of the heald shaft 16 takes place with a higher r.p.m. than the r.p.m. of the reed drive shaft. As shown in FIGS. 4 and 5 the gears or coupling elements 21A, 22A and 22B, 25B are preferably axially facing gear rims.

As mentioned above, the second gears of the auxiliary gear 13 have an upward gear transmission ratio within the range of i=1:2 to 1:3, whereby the heald drive shaft may be driven faster when the auxiliary gear is switched into the transmission chain with the aid of the coupling section of the auxiliary gear. The coupling section 22 of the auxiliary gear 13 is operatively mounted for axial displacement along and for rotation with the drive shaft 20 of the auxilliary gear 13. The heald drive shaft is driven faster with the stepped-up ratio when the second gears 21A, 22A, 21, 27, 28, 25A of the auxiliary gear 13 are switched on with the coupling 22 in the right-hand position as shown in FIG. 5. As a result, during backward weaving the heald drive shaft 16 is turned backward simultaneously with the main drive shaft of the loom, however at a higher angular speed. Due to this operation, the reed is moved within a given angular range back between the beat-ups while the shed forming heddles or rather their drive shaft is rotated backward to a point or rather angular shaft position at which the heald drive shaft was at the time of the detection of a weft thread fault. This point is referred to herein as the "detection point". The detection point signifies a point in time and also a particular angular position of the relevant loom components at that time, namely when the weft fault was detected.

Figure 6:
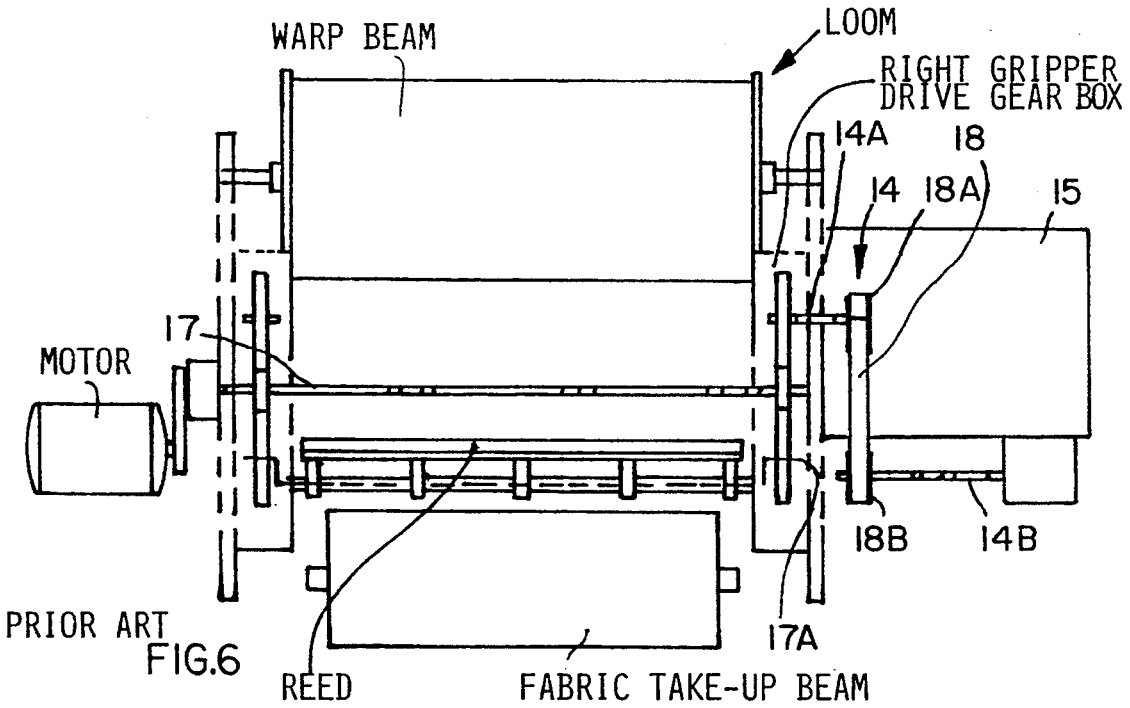
PRIOR ART FIG.6
FIG. 6 shows a schematic view of a conventional loom without an auxiliary gear for a controlled back-weaving.
Figure 7:
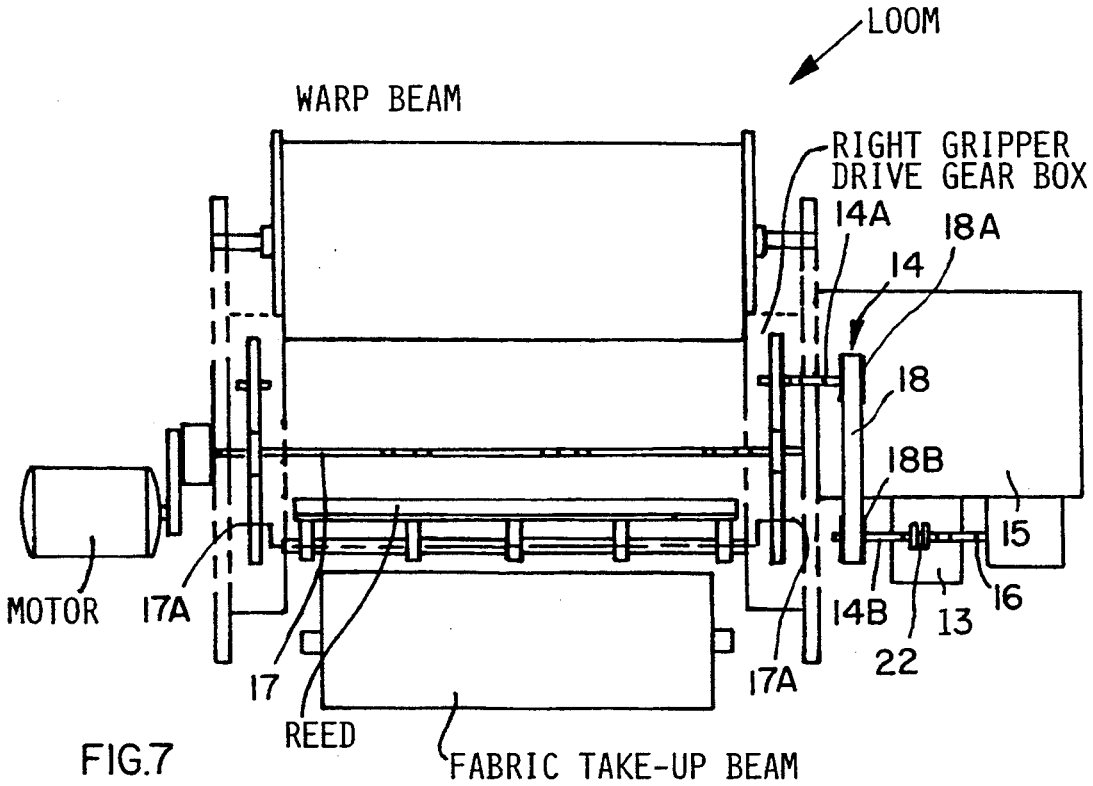
FIG. 7 shows a view similar to FIG. 6, but including an auxiliary gear and coupling device for a controlled back-weaving.

FIG. 6 shows schematically the overall drive system of a conventional power loom. FIG. 7 illustrates the position of the present auxiliary gear 13 in the drive system of the loom.

Although the invention has been described with reference to specific example embodiments, it will be appreciated that it is intended to cover all modifications and equivalents within the scope of the appended claims.

What we claim is:

1. A method for avoiding markings that can be caused by a read beat-up motion when a faulty weft thread must be removed from a fabric being woven on a loom having a reed with a reed drive shaft, a heald loom section with a heald drive shaft, a loom main drive shaft, power transmission means including a transmission output, and coupling means for switching an auxiliary gear drive interposed between said transmission output shaft, said heald drive shaft, comprising the following steps:

(a) detecting the presence of a faulty weft thread, (b) generating a weaving stop signal in response to said detecting and stopping a weaving operation in response to said weaving stop signal, (c) causing a temporarily continuing rotation of said loom main drive shaft, of said reed drive shaft, and of said heald drive shaft in the same direction in which said loom main drive shaft, said reed drive shaft, and said heald drive shaft were rotating at the time of said stopping of said weaving operation, said continuing rotation passing through an angular range that is smaller than 360°, (d) switching said auxiliary gear drive from a first transmission ratio to a second stepped up transmission ratio, (e) causing a simultaneous reverse rotation of said reed drive shaft and of said heald drive shaft in a direction opposite to said temporarily continuing rotation, in such a way that a first number of reverse rotational degrees of said loom main drive shaft and of said reed drive shaft is smaller than 360° while a second number of reverse rotational degrees of said heald drive shaft is larger than 360°, and (f) then switching said auxiliary gear drive down from said stepped-up transmission ratio to said first transmission ratio, whereby a beat-up motion of said reed is avoided during back-weaving for removing said faulty weft thread.

2. The method of claim 1, wherein said simultaneous reverse rotation comprises reversely rotating said loom main drive shaft with a first reverse r.p.m. and said heald drive shaft with a second reverse r.p.m. which is higher than said first reverse r.p.m. of said loom main drive shaft.

3. The method of claim 2, further comprising imposing by said coupling means a step-up transmission ratio of 1:2 to 1:3 for achieving said second higher reverse r.p.m. of said heald drive shaft.

4. An apparatus for avoiding markings that can be caused by a reed beat-up motion when a faulty weft thread must be removed from a fabric being woven on a loom comprising a reed drive shaft, a heald loom section with a heald drive shaft, a loom main drive shaft, power transmission means, including a transmission output shaft, an auxiliary gear drive, and a coupling for switching said auxiliary gear drive between said transmission output shaft and said heald shaft, said auxiliary gear drive comprising first gear wheels and second gear wheels providing said auxiliary gear drive with a step-up transmission ratio within the range of 1:2 to 1:3, whereby said first gear wheels first rotate said heald drive shaft in a first temporary rotation in the same direction in which said heald drive shaft was rotating at the time of or just prior to a stopping of a weaving operation, said temporary first rotation passing through an angular range that is smaller than 360°, wherein said coupling includes means for disconnecting said heald drive shaft from said first gear wheels of said auxiliary gear drive and connecting said heald drive shaft to said second gear wheels of said auxiliary gear drive for causing a reverse second rotation of said heald drive shaft in a direction opposite to said temporary first rotation at a higher angular speed than said main drive shaft in accordance with said step-up transmission ratio.

5. The apparatus of claim 4, wherein said coupling is arranged on an input drive shaft of said auxiliary gear drive between a drive input gear wheel of said second gear wheels, said input gear wheel being rotatably mounted on said input drive shaft, and a drive output gear wheel of said second gear wheels, said drive output gear wheel being rigidly connected to an output shaft operatively connected to said heald drive shaft, said coupling being adapted to be axially slidable on and rotationally driven by said input drive shaft for engaging one of said input and output gear wheels by an axial shifting of said coupling along said input drive shaft.

6. The apparatus of claim 4, wherein said coupling is shiftable selectively by a pneumatic or mechanical or electromechanical drive.

7. The apparatus of claim 4, wherein said auxiliary gear drive comprises a drive input shaft connected to said transmission output shaft, a rotatably mounted by-pass shaft arranged in parallel to said drive input shaft, and an output shaft connected to said heald shaft, said coupling comprising a bushing slidably mounted on and driven by said drive input shaft for driving said output shaft through said first gear wheels in a first position of said coupling and for driving said output shaft through said second gear wheels in a second position of said coupling, whereby said step-up ratio is realized when said second gear wheels are engaged.

8. The apparatus of claim 7, wherein said first gear wheels comprise one first gear rigidly mounted on said coupling and another first gear rigidly mounted on said output shaft, said first gears meshing with each other to form a first forward drive train when said coupling is in said first position, and wherein said second gear wheels form a second reverse drive train comprising an input pinion rotatably mounted on said drive input shaft, an axially facing gear rim on said pinion, an axially facing further gear rim on said coupling, said axially facing gear rims meshing with each other when said coupling is in said second position for driving said input pinion, two by-pass pinions carried by said by-pass shaft, one by-pass pinion meshing with said input pinion, and an output pinion rigidly connected to said output shaft for meshing with the other by-pass pinion for reversely driving said output shaft.

9. The apparatus of claim 8, wherein said first gear wheels are axially facing gear rims on said coupling and on said output shaft.

* * * * *